US006735402B2

(12) United States Patent
Oki

(10) Patent No.: US 6,735,402 B2
(45) Date of Patent: May 11, 2004

(54) IMAGE FORMING APPARATUS WITH CURRENT-CONTROLLED TRANSFER VOLTAGE FEATURE

(75) Inventor: Miyuki Oki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/055,985

(22) Filed: Jan. 28, 2002

(65) Prior Publication Data

US 2002/0106210 A1 Aug. 8, 2002

(30) Foreign Application Priority Data

Jan. 29, 2001 (JP) ..... 2001-020469
Mar. 16, 2001 (JP) ..... 2001-076809
Jan. 25, 2002 (JP) ..... 2002-017551

(51) Int. Cl.[7] ..... G03G 15/01; G03G 15/16
(52) U.S. Cl. ..... 399/66; 399/298
(58) Field of Search ..... 399/66, 121, 298

(56) References Cited

U.S. PATENT DOCUMENTS 5,600,421 A * 2/1997 Takekoshi et al. ..... 399/66
5,893,659 A * 4/1999 Nanjo et al. ..... 399/66 X
5,903,798 A * 5/1999 Yokogawa et al. ..... 399/66
5,915,145 A * 6/1999 Shimura et al. ..... 399/66
6,026,257 A * 2/2000 Takami et al. ..... 399/66
6,070,025 A * 5/2000 Jeong ..... 399/66
6,148,159 A * 11/2000 Shiraishi ..... 399/66 X
6,498,907 B2 * 12/2002 Yoda ..... 399/66 X

* cited by examiner

*Primary Examiner*—Fred L. Braun
(74) *Attorney, Agent, or Firm*—Fitzpatrick, Cella, Harper & Scinto

(57) ABSTRACT

An image forming apparatus includes an image bearing member and a transferring member for transferring a toner image on the image bearing member onto a recording material in a transferring portion of the image forming apparatus. When the recording material is not present in the transferring portion, a voltage is applied to the transferring member, and on the basis of an electric current then flowing in the transferring member, a voltage applied to the transferring member, when a non-image portion of the image bearing member is in the transferring portion, is controlled.

15 Claims, 11 Drawing Sheets

IMAGE FORMING APPARATUS WITH CURRENT-CONTROLLED TRANSFER VOLTAGE FEATURE

BACKGROUND OF THE INVENTION

1. Field of the Invention

This invention relates to an image forming apparatus of the electrophotographic type or the electrostatic recording type, and particularly to an image forming apparatus in which a voltage applied to a transferring member disposed in opposed relationship with an image bearing member is controlled.

2. Related Background Art

FIG. 8 of the accompanying drawings schematically shows the construction of a popular image forming apparatus. The image forming apparatus shown in FIG. 8 is a printer of the transfer type utilizing the electrophotographic process.

A drum-shaped electrophotographic photosensitive member (photosensitive drum) 1 as an image bearing member is rotatively driven in the direction of arrow R9 at a predetermined peripheral speed (process speed), and image forming process such as electrifying image exposing, developing, transferring and cleaning are applied to this photosensitive drum 1.

That is, the photosensitive drum 1 is rotatively driven and the surface thereof is uniformly electrified to a predetermined polarity and predetermined potential by an electrifying roller (primary electrifier) 2. In the present example, a description will be made of a case where a photosensitive drum minus-electrified is used.

Next, image exposing by image exposing means (such as a scanning exposing apparatus of an image-modulated laser beam) 3 as image information writing means is effected on the electrified surface of the photosensitive drum, whereby the electrifying potential of an exposed light portion is attenuated and an electrostatic latent image corresponding to the exposed image information is formed on the surface of the photosensitive drum 1.

This electrostatic latent image is sequentially developed (visualized) as a transferable image) at a developing region N6 by the developing sleeve 4*a* of a developing device 4.

The thus developed toner image is transferred to a recording material P at a transferring region (transfer nip part) N5 by transferring means. The transferring means in the present example is transferring means of the contact transfer type using a transferring roller (contact transferring electrifier) 9.

The transferring roller 9 is comprised, for example, of a mandrel and an elastic layer of medium resistance formed around the mandrel, and is brought into pressure contact with the photosensitive drum 1 with a predetermined pressure force against the elasticity of the elastic layer to thereby form the transferring region N5. The transferring roller 9 is rotated in a forward direction relative to the rotation of the photosensitive drum 1 in the direction of arrow R9, i.e., the direction of arrow R10, substantially at the same peripheral speed as the peripheral speed of the photosensitive drum 1.

The recording material P is fed from a sheet feeding cassette (feeding means portion) 13 and is subjected to timing adjustment and fed to the transferring region N5 by registration rollers (not shown) disposed at the upstream side of the transferring region N5. That is, the registration rollers feed the recording material P to the transferring region N5 at such timing that just when the leading edge portion of the area of the toner image formed on the surface of the photosensitive drum 1 has arrived at the transferring region N5, the leading edge portion of the recoding material P also arrives at the transferring region N5.

The recording material P fed to the transferring region N5 is nipped and conveyed through the transferring region N5 with its surface kept in close contact with the photosensitive drum 1. Also, during the time from after the leading edge portion of the recording material P has arrived at the transferring region N5 until the trailing edge portion thereof leaves the transferring region N5, a predetermined transferring bias voltage of the plus polarity is applied from a transferring bias application voltage source (not shown) to the mandrel of the transferring roller 9.

In the process of the recording material P being nipped and conveyed through the transferring region N5, the toner image on the photosensitive drum 1 is sequentially transferred onto the recording material P by the action of a transferring electric field formed by the transferring roller 9 and the pressure force at the transferring region N5.

When it leaves the transferring region N5, the recording material P is separated from the surface of the photosensitive drum 1 and is conveyed to a fixing device 12, whereby the transferred toner image thereon is fixed as a permanent image on the surface of the recording material P, whereafter the recording material P is discharged as an image-formed article (a copy or a print).

The photosensitive drum 1 after the separation of the recording material P therefrom has adhering contaminants such as any residual lower and paper dust remaining on its surface removed by the cleaning blade 10 of a cleaner 11, and is used for the next image formation.

As the image forming process, there are, for example, a regular developing process in which the electrified surface of the photosensitive member is exposed correspondingly to the background portion of image information (a background exposing process), and the other non-exposed portion than the background portion is developed, and a reversal developing process in which conversely the electrified surface of the photosensitive member is exposed correspondingly to an image information portion (an image exposing process) and the exposed portion thereof is developed, and these are used with their features utilized efficiently.

During the time from after the recording material P passes through the transferring region N5 until the next recording material P arrives at the transferring region N5, in order to prevent the unevenness of the potential of the photosensitive drum and to quicken the rising of the transferring voltage in the case of the next recording material, a voltage is applied from the transferring bias application voltage source to the transferring roller 9. As this voltage, a voltage (non-sheet passing portion bias) smaller than that during transfer is applied. This is for preventing the flow of an excessive current to the photosensitive drum 1 by a transferring bias voltage equal to that during transfer being applied in the absence of the recording material P and further, preventing the photosensitive drum 1 from being plus-electrified.

Heretofore, this non-sheet passing portion bias has been fixed to one which minimizes the influence upon the photosensitive drum 1, such as the discharge starting voltage of the photosensitive drum 1 or less. This also holds true of an image forming apparatus using, for example, a recording material conveying belt, a recording material conveying drum or the like besides the transferring roller 9.

Now, the above-described transferring roller 9, the recording material conveying belt, the recording material conveying drum, etc. change greatly in resistance. Therefore, in an apparatus wherein the non-sheet passing portion bias is made constant, the amount of plus electrification received by the photosensitive drum 1 may become excessive when the resistance of these members lowers, and even after the photosensitive drum is primary-electrified by the electrifying roller 2, a predetermined amount of electrification cannot be maintained and the electrifying potential may sometimes become small.

In such case, in reversal developing, there is formed an image high in density over a round of the drum from the leading edge of the recording material P, and in regular developing, there is formed an image low in density over a round of the drum from the leading edge of the recording material P.

Further, when DC electrification is used, charges electrified to electrifying potential or higher in DC electrification cannot be eliminated and therefore, when the resistance of the recording material P rises due to an environmental fluctuation or an endurance fluctuation, white spots are created in the reversal developing by the bad charge elimination of an excessively electrified portion, and black spots are created in the regular developing and further, uneven electrification occurs to a halftone image or the like.

In contrast, heretofore, this has been coped with by effecting ante-electrification exposure or an ante-electrification preliminary charging process.

According to this, however, an apparatus (instrument) for effecting the ante-electrification exposure or the ante-electrification preliminary charging process is necessary, and this has led to the problem that the construction becomes correspondingly complicated.

SUMMARY OF THE INVENTION

It is an object of the present invention to provide an image forming apparatus in which even if an environmental fluctuation or the like occurs, the electrifying potential on an image bearing member is stabilized to thereby prevent the uneven density of an image.

It is another object of the present invention to provide an image forming apparatus comprising an image bearing member and a transferring member for transferring a toner image on the image bearing member onto a recording material in a transferring portion, wherein when the recording material is not present in the transferring portion, a voltage is applied to the transferring member, and on the basis of an electric current then flowing to the transferring member, a voltage applied to the transferring member when the non-image portion of the image bearing member is in the transferring portion is controlled.

Further objects of the present invention will become apparent from the following description.

DESCRIPTION OF THE PREFERRED EMBODIMENTS

Some embodiments of the present invention will hereinafter be described with reference to the drawings.

Figure 1:
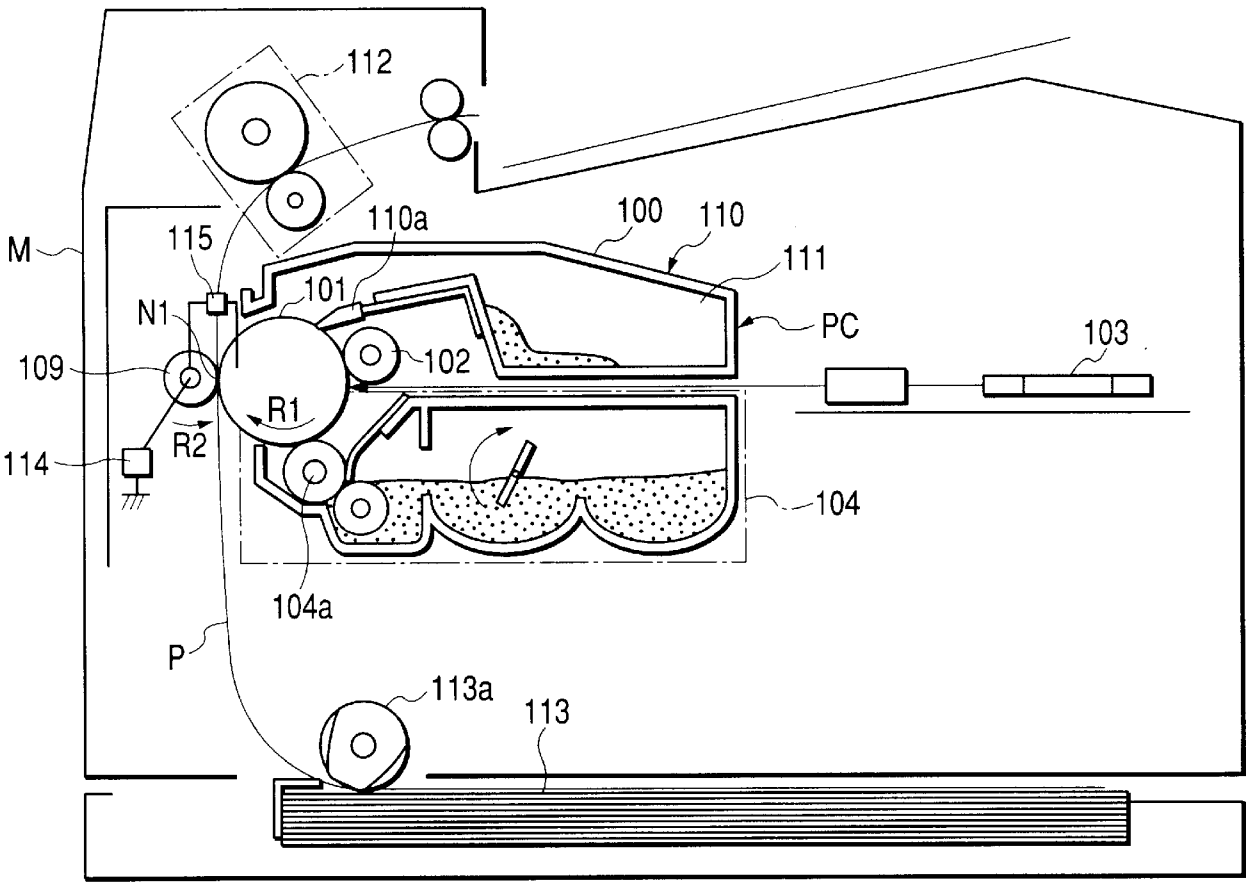
FIG. 1 is a cross-sectional view of an image forming apparatus which is an embodiment of the present invention.

FIG. 1 shows an embodiment of an image forming apparatus according to the present invention. The image forming apparatus shown in FIG. 1 is a laser beam printer of the electrophotographic type, and FIG. 1 is a longitudinal cross-sectional view schematically showing the construction thereof. In the following description, a case where reversal developing is effected by the use of a photosensitive drum 101 having a minus electrification characteristic and a toner carrying minus charges will be described as an example.

The image forming apparatus shown in FIG. 1 is provided with a drum-shaped electrophotographic photosensitive member (hereinafter referred to as the "photosensitive drum") 101 as an image bearing member. The photosensitive drum 101 is rotatably supported by the main body M of the image forming apparatus (hereinafter simply referred to as the main body of the apparatus), and is rotatively driven in the direction of arrow R1 by driving means (not shown). An electrifying roller (electrifying means or a primary electrifier) 102 for uniformly electrifying the surface of the photosensitive drum, an exposing apparatus (exposing means) 103 for forming an electrostatic latent image conforming to image information on the surface of the photosensitive drum 101 after electrified, a developing device (developing means) 104 for developing the electrostatic latent image, a transferring roller (transferring member) 109 for transferring a toner image on the photosensitive drum 101 to a recording material P such as paper, a cleaning apparatus (cleaning means) 110 for removing any primary-untransferred toner on the photosensitive drum 101, etc. are disposed around the photosensitive drum 101 along the direction of rotation thereof substantially in the named order.

The above-mentioned members will now be complementally described.

The photosensitive drum 101 is comprised of a cylindrical mandrel (base body) of aluminum and for example, an OPC (organic photosemiconductor) photosensitive layer having a minus electrification characteristic and provided on the surface of the mandrel.

The primary charger has the electrifying roller 102 disposed in contact with the surface of the photosensitive drum 101, and an electrifying bias application voltage source (not shown) for applying to the electrifying roller a vibration voltage comprising a peak-to-peak voltage of 233 Vth (Vth being the discharge starting voltage of the photosensitive drum) or greater superimposed on a DC voltage corresponding to desired dark portion potential VD, and uniformly electrifies the surface of the photosensitive drum 101 to a predetermined polarity and predetermined potential.

The exposing apparatus 103 has, for example, a laser asciallator emitting a laser beam conforming to the image information, a polygon mirror, etc., and is adapted to scan the surface of the photosensitive drum after being charged and eliminate the charges of the portion thereof to which light has been applied, thereby forming an electrostatic latent image thereon.

The developing device 104 contains therein a negative toner carrying charges to minus by friction, and this negative toner is carried on the surface of a developing roller 104*a* and is carried to a developing region facing the surface of the photosensitive drum 101. A developing bias is applied to the developing device 104 by a developing bias application voltage source (not shown), whereby the toner is made to adhere to that portion of the surface of the photosensitive drum 101 from which the charges of the electrostatic latent image have been eliminated. Thus, the electrostatic latent image is developed as a toner image.

The transferring roller 109 is brought into contact with the surface of the photosensitive drum 101 to thereby form a transferring region (transferring nip part) N1 between itself and the surface of the photosensitive drum 101. A transferring bias is applied to the transferring roller 109 by a transferring bias application voltage source 114 which is a high voltage source as voltage applying means, whereby the toner image on the surface of the photosensitive drum 101 may be transferred to the surface of the recording material P.

The cleaning apparatus 110 is provided with a cleaning blade 110*a* abutting against the surface of the photosensitive drum for scraping off any untransferred toner adhering to the surface of the photosensitive drum, and a waste toner container 111 for collecting the scraped-off toner.

The operation of the image forming apparatus of the above-described construction will now be described.

For example, the surface of the photosensitive drum 101 is uniformly charged to −700V by the electrifying roller 102 with a vibration voltage comprising an AC voltage of a peak-to-peak voltage of 1200V corresponding to 2×Vth superimposed on a DC voltage of −700V applied thereto. Then, exposure conforming to the image information is effected by the exposing apparatus 103 to thereby form an electrostatic latent image. On the surface of the photosensitive drum 101 after exposure, the dark portion potential VD of the unexposed portion thereof is −700V and the light portion potential VL of the exposed portion thereof is −100V. A developing bias of −400V is applied to the developing sleeve 104*a* of the developing device 104 by a developing bias application voltage source, whereby the minus charged negative toner does not adhere to the unexposed portion (hereinafter referred to as the "VD portion") of the surface of the photosensitive drum 101, whereas it adheres to the exposed portion (hereinafter referred to as the "VL portion") thereof and is visualized (developed) as a toner image.

The photosensitive drum 101 and the transferring roller 109 are rotated at the same speed in the direction of arrow R1 and the direction of arrow R2, respectively, and a primary transferring bias is applied to the transferring roller 109 by a transferring bias application voltage source 114. Thereby, the toner image on the photosensitive drum 101 is transferred from the surface of the photosensitive drum 101 to the recording material P in a transferring region N1 by the potential difference between the photosensitive drum 101 and the transferring roller 109. The recording material P is adapted to be supplied from a sheet feeding cassette 113 to the transferring region N1 by a sheet feeding roller 113*a* or the like.

After the transfer of the toner image, a surface of the photosensitive drum 101 has toner thereon, which has not transferred to the recording material P, which is removed by the cleaning blade 110*a* of the cleaning apparatus 110 and collected into a waste toner container 111, and which is used for the next image formation.

On the other hand, the recording material P after the transfer of the toner image thereto is conveyed to a fixing apparatus 112 by conveying means (not shown, and there it is heated and pressurized and the toner image is fixed as a permanent image on the surface thereof, whereafter the recording material P is discharged out of the main body M of the apparatus.

A description will now be made of the control of the non-sheet passing portion bias which is a feature of the present invention.

First, when the image forming operation is to be started, the photosensitive drum 101 and the transferring roller 109 are rotated in the direction of arrow R1 and the direction of arrow R2, respectively, by driving means.

At this time, a DC voltage of 1000V is applied from a transferring bias application voltage source 114 to the transferring roller 109. An electric current I flowing between the transferring roller 109 and the photosensitive drum 101 when this voltage is applied is detected by current detecting means 115. That is, an electric current per 1000V flowing between the photosensitive drum 101 and the transferring roller 109 is detected from I.

Figure 2:
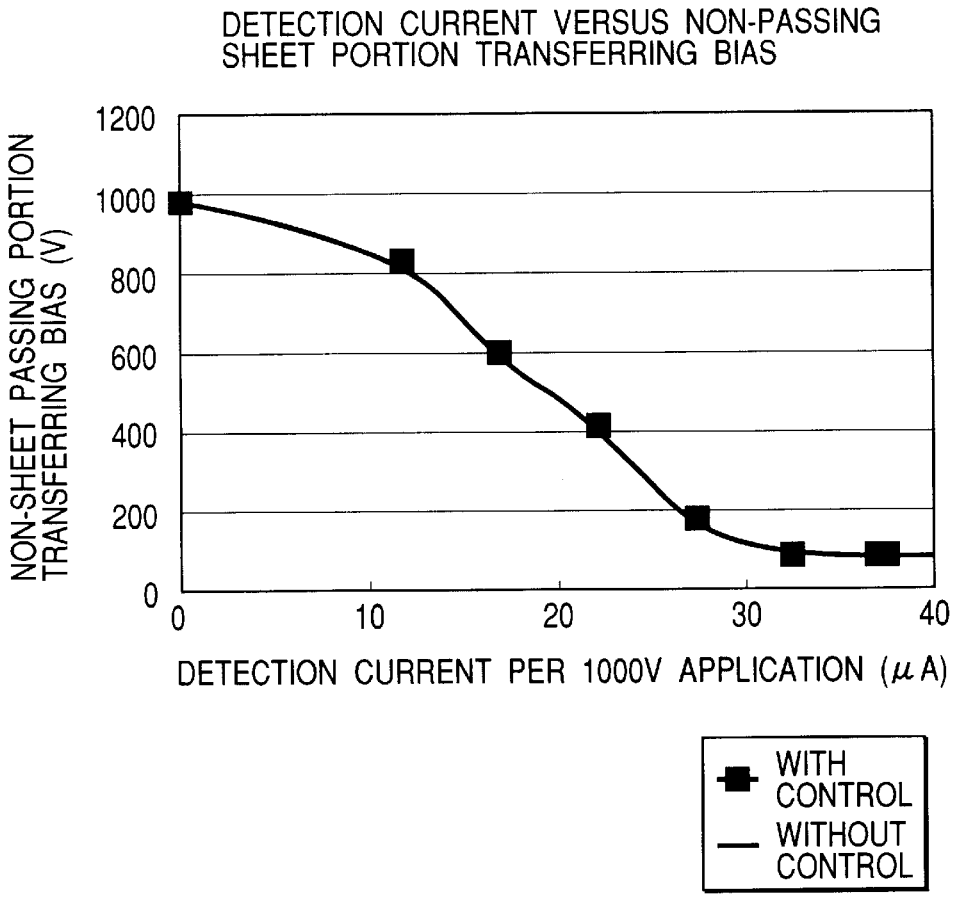
FIG. 2 is a graph showing the relation between a detection current and a non-sheet passing portion transferring bias.

FIG. 2 is a graph showing the non-sheet passing portion transferring bias to the detection current, and represents such a non-sheet passing portion transferring bias as will cause an optimum current to flow to the non-sheet passing portion (non-image forming portion).

Constant voltage control is effected so that the control voltage value V of the non-sheet passing portion transferring bias corresponding to the actually detected current I may be determined from this detection current I and FIG. 2 and be applied to the non-sheet passing portion. The relation between the detection current per 1000V shown in FIG. 2 and the non-sheet passing portion transferring bias may be put into the form of a conversion table or a conversion expression in advance, for example, by an experiment or the like.

The timing at which this non-sheet passing portion transferring bias is applied will now be described with reference to FIGS. 3 and 4.

Figure 3:
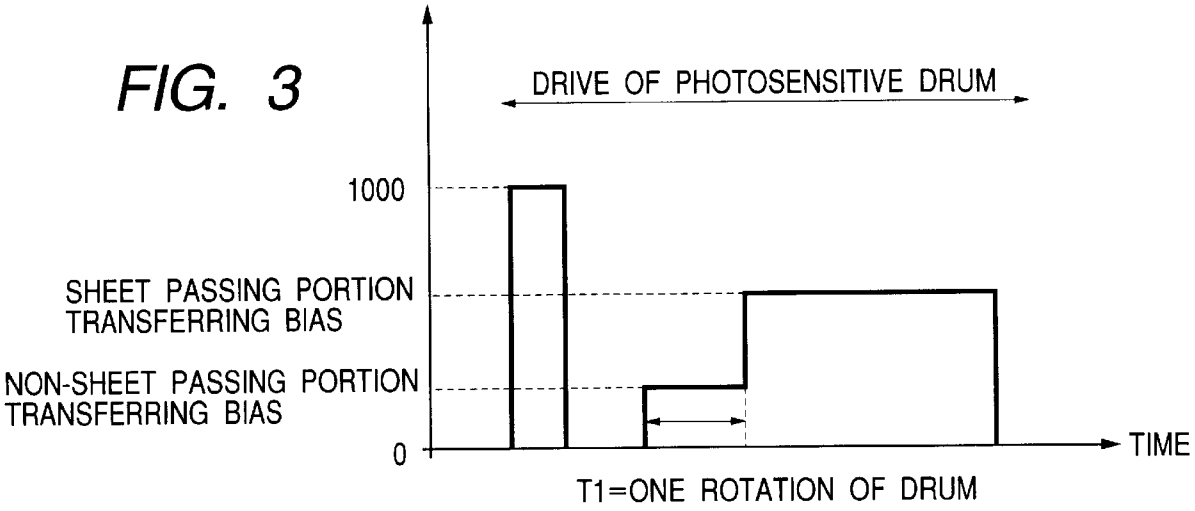
FIG. 3 is a diagram showing the timing at which the non-sheet passing portion transferring bias is applied in one-sheet printing.
Figure 4:
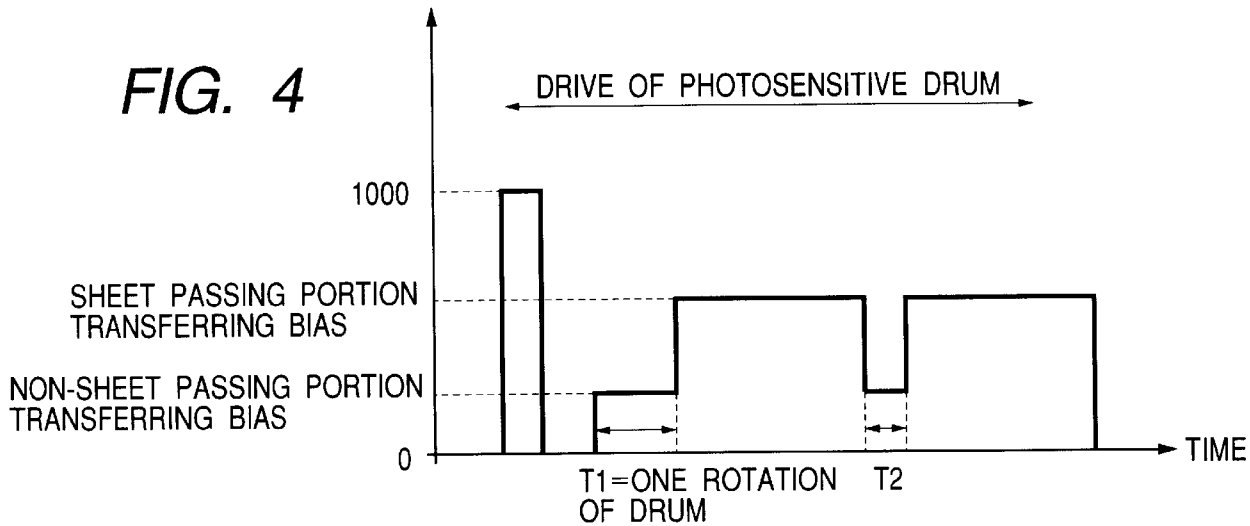
FIG. 4 is a diagram showing the timing at which the non-sheet passing portion transferring bias is applied in continuous printing.

FIGS. 3 and 4 show in time-series voltages applied to the transferring roller 109 when one-sheet printing (image formation) is effected and when continuous printing is effected, respectively.

As shown in FIG. 3, it is preferable that a time T1 for which the non-sheet passing portion transferring bias is applied be a time corresponding to at least one rotation of the photosensitive drum 101 from the leading edge of the recording material P. However, when as shown in FIG. 4, the non-sheet passing portion T2 between images (between a recording material and a recording material) is less than an amount corresponding to one rotation of the photosensitive drum in continuous sheet passing or the like, a proper bias in the sheet passing portion is preferentially applied and therefore, there will be no problem even if the application of the above-described non-sheet passing portion transferring bias is less than the amount corresponding to one rotation of the photosensitive drum.

By doing as described above, even if the resistance of the transferring roller 109 is changed by any environmental fluctuation, the amount of plus electrification received by the photosensitive drum 101 in the non-sheet passing portion can be made proper.

Figure 5:
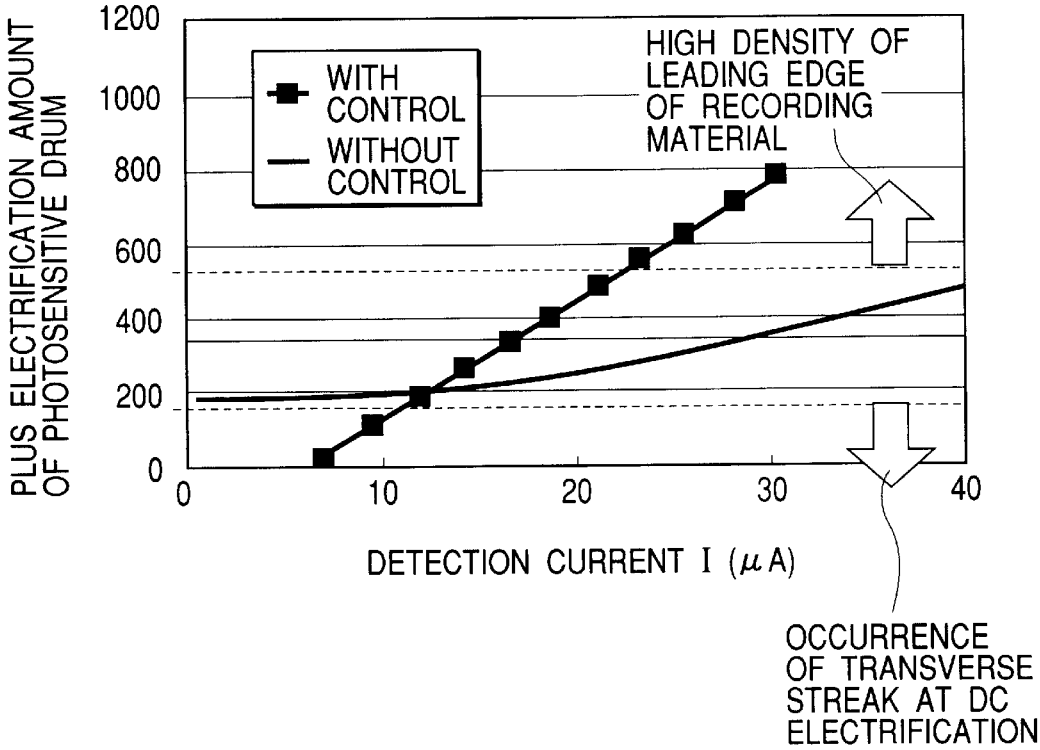
FIG. 5 is a graph showing the relation between the detection current and the amount of plus electrification of a photosensitive drum.

This will hereinafter be described with reference to FIG. 5. FIG. 5 is a graph showing the amount of plus electrification received by the photosensitive drum in the non-sheet passing portion to the detection current. Heretofore, when the resistance of the transferring roller has lowered and the detection current has become great, the amount of plus electrification received by the photosensitive drum has become excessive and a high density (in the case of reversal developing) image has occurred on the leading edge of the recording material P.

However, by using the construction and control of the present embodiment, the control voltage has not posed the problem as noted above because the amount of plus electrification is controlled to a proper range as shown in FIG. 5, and a good image has been obtained.

It will be seen that as described above, by this control, I becomes great and the resistance of the transferring roller 109 is small under a high-temperature and high-humidity (H/H: temperature 32.5° C., humidity 85%) environment and therefore, a relatively low non-image portion voltage Va is applied, and it will be seen that conversely, I becomes small and the resistance of the transferring roller 109 is great under a low-temperature and low-humidity (L/L: temperature 15° C., humidity 10%) environment and therefore, a relatively high non-image portion voltage Vc is applied. Under a normal-temperature and normal-humidity (N/N: temperature 23° C., humidity 64%) environment, a voltage Vb substantially intermediate of the above-mentioned Va and Vc may be applied to the transferring roller 109, whereby a substantially desired non-sheet passing portion transferring bias may be obtained under all environments.

In the present embodiment, the above-described photosensitive drum 101, electrifying roller 102, developing device 104 and cleaning apparatus 110 are integrally incorporated into a cartridge container 100 to thereby constitute a process cartridge PC detachably attachable to the main body M of the apparatus. The process cartridge will suffice if it has at least the photosensitive drum 101.

Another embodiment of the present invention will now be described.

Figure 6:
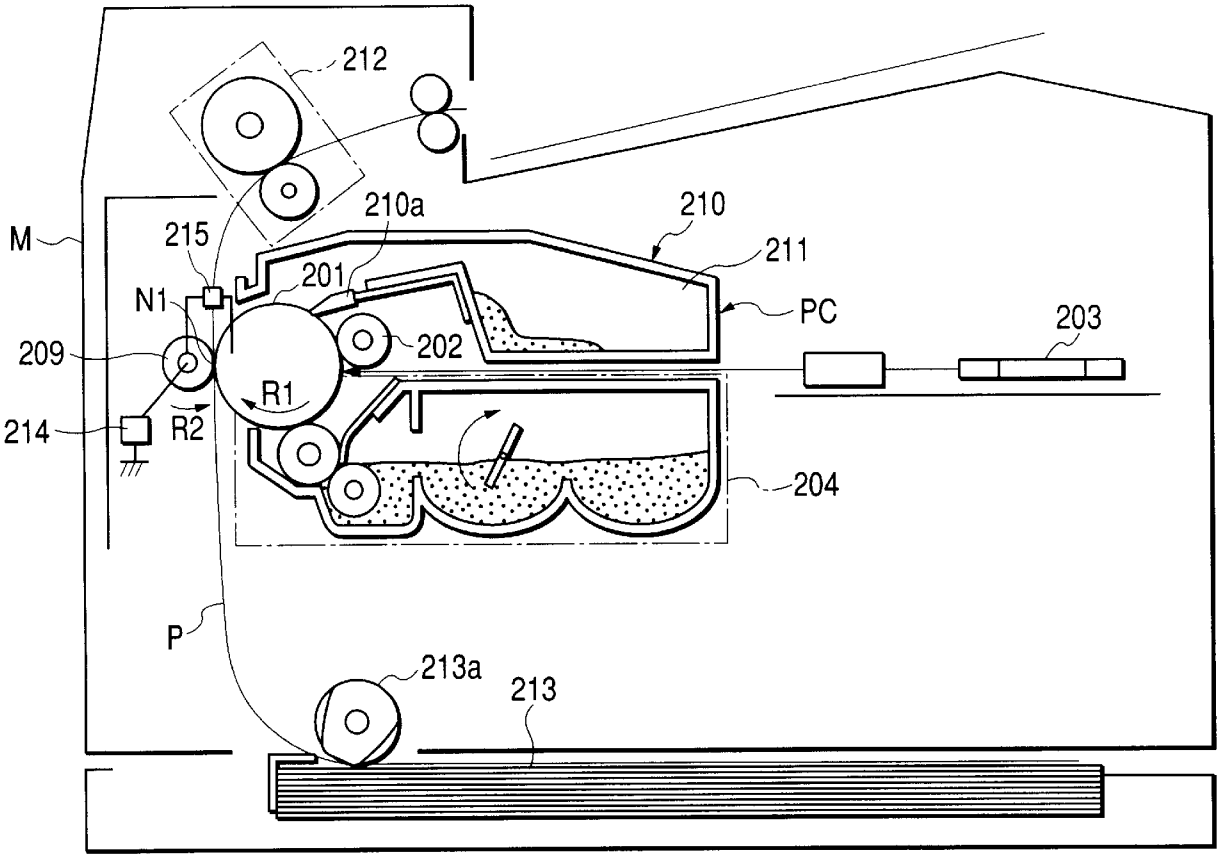
FIG. 6 is a cross-sectional view of an image forming apparatus which is another embodiment of the present invention.

FIG. 6 shows an embodiment of the image forming apparatus according to the present invention. The image forming apparatus shown in FIG. 6 is a laser beam printer of the electrophotographic type, and FIG. 6 is a longitudinal cross-sectional view schematically showing the construction thereof. In the following description, a case where reversal developing is effected by the use of a photosensitive drum 201 having a minus electrification characteristic and a toner carrying minus charges will be described as an example.

The image forming apparatus shown in FIG. 6 is provided with a drum-shaped electrophotographic photosensitive member (hereinafter referred to as the "photosensitive drum") 201 as an image bearing member. The photosensitive drum 201 is rotatably supported by the main body M of the image forming apparatus (hereinafter simply referred to as the "main body of the apparatus"), and is rotatively driven in the direction of arrow R1 by driving means (not shown). An electrifying roller (electrifying means or a primary electrifier) 202 for uniformly electrifying the surface of the photosensitive drum, an exposing apparatus (exposing means) 203 for forming an electrostatic latent image conforming to image information on the surface of the photosensitive drum 201 after electrified, a developing device (developing means) 204 for developing the electrostatic latent image, a transferring roller (transferring member) for transferring a toner image on the photosensitive drum 201 to a recording material P such as paper, a cleaning apparatus (cleaning means) 210 for removing any untransferred toner on the photosensitive drum 201, etc. are disposed around the photosensitive drum 201 along the direction of rotation thereof substantially in the named order.

The above-described members will be complementally described subsequently.

The photosensitive drum 201 is comprised of a cylindrical mandrel (base body) of aluminum and for example, an OPC (organic photosemiconductor) photosensitive layer having a minus electrification characteristic and provided on the surface of the mandrel.

The primary electrifier has the electrifying roller 202 disposed in contact with the surface of the photosensitive drum 201, and an electrifying bias application voltage source (not shown) for applying a minus DC (direct current) bias thereto, and uniformly electrifies the surface of the photosensitive drum 201 to a predetermined polarity and predetermined potential.

The exposing apparatus 203 has, for example, a laser oscillator emitting a laser beam conforming to the image information, a polygon mirror, etc., and is adapted to scan the surface of the photosensitive drum after charged and eliminate the charges of the portion thereof to which the light is applied, thereby forming an electrostatic latent image.

The developing device 204 contains therein a negative toner carrying minus charges by friction, and this negative toner is carried on the surface of a developing roller 204*a* and is carried to a developing region facing the surface of the photosensitive drum 201. A developing bias is applied to the developing device 204 by a developing bias application voltage source (not shown), whereby the toner adheres to that portion of the surface of the photosensitive drum 201 from which the charges of the electrostatic latent image have been removed. Thus, the electrostatic latent image is developed as a toner image.

The transferring roller 209 is brought into contact with the surface of the photosensitive drum 201 to thereby form a transferring region (transferring nip portion) N1 between itself and the surface of the photosensitive drum 201. A transferring bias is applied to the transferring roller 209 by a transferring bias application voltage source 214 which is a high voltage source as voltage applying means, whereby the toner image on the surface of the photosensitive drum 201 may be transferred to the surface of the recording material p.

The cleaning apparatus 210 is provided with a cleaning blade 210*a* abutting against the surface of the photosensitive drum for scraping off any untransferred toner adhering to the surface of the photosensitive drum, and a waste toner container 211 for collecting the scraped-off toner.

A fixing apparatus 212 heats and pressurizes the toner image transferred onto the recording material P to thereby fix it on the surface of the recording material P.

The operation of the image forming apparatus of the above-described construction will now be described.

For example, the surface of the photosensitive drum 201, when a DC voltage −1250 is applied thereto by the electrifying roller 202, is uniformly electrified to −700V. Then, exposure conforming to the image information is effected by the exposing apparatus 203, whereby an electrostatic latent image is formed. The surface of the photosensitive drum 201 after the exposure is such that the dark portion potential VD of the unexposed portion thereof is −700V and the light portion potential VL of the exposed portion thereof is −100V. A developing bias of −400V is applied to the developing sleeve 204*a* of the developing device 204 by a developing bias application voltage source, whereby the minus-electrified negative toner does not adhere to the unexposed portion (hereinafter referred to as the "VD portion") of the surface of the photosensitive drum 201, whereas it adheres to the exposed portion (hereinafter referred to as the "VL portion") thereof and the electrostatic latent image is visualized (developed) as a toner image.

The photosensitive drum 201 and the transferring roller 209 are rotated at the same peripheral speed in the direction of arrow R1 and he direction of arrow R2, respectively, and a primary transferring bias is applied to the transferring roller 209 by a transferring bias application voltage source 214. Thereby, the toner image of the photosensitive drum 201 is transferred from the surface of the photosensitive drum 201 to the recording material P such as paper in the transferring region N1 by the potential difference between the photosensitive drum 201 and the transferring roller 209. Design is made such that the recording material P is supplied from a sheet feeding cassette 213 to the transferring region N1 by a sheet feeding roller 213*a* or the like.

The photosensitive drum 201 after the transfer of the toner image therefrom has any untransferred toner residual on its surface without being transferred to the recording material P removed by the cleaning blade 210*a* of the cleaning apparatus 210 and collected into the waste toner container 211, and is used for the next image formation.

On the other hand, the recording material P after the transfer of the toner image thereto is conveyed to the fixing apparatus 212 by conveying means (not shown), and it is heated and pressurized there, whereby the toner image is fixed as a permanent image on the surface of the recording material P, whereafter the recording material P is discharged out of the main body M of the apparatus.

A description will now be made of the control of the non-sheet passing portion bias which is a feature of the present invention.

First, when the image forming operation is to be started, the photosensitive drum 201 and the transferring roller 209 are rotated in the direction of arrow R1 and the direction of arrow R2, respectively, by driving means (not shown).

At this time, a DC voltage of 1000V is applied from the transferring bias application voltage source 214 to the transferring roller 209. An electric current I flowing between the transferring roller 209 and the photosensitive drum 201 when this voltage is applied is detected by current detecting means 215. That is, an electric current per the application of 1000V flowing between the photosensitive drum 201 and the transferring roller 201 is detected from I.

As described above, FIG. 2 is a graph showing the non-sheet passing portion transferring bias to the detection current, and represents such a non-sheet passing portion transferring bias as will cause an optimum electric current to flow from the detection current.

Control is effected so that the control value V of the non-sheet passing portion transferring bias corresponding to the actually detected current I may be determined form the detection current I and FIG. 2, and may be applied to the non-sheet passing portion. The relation between the detection current per the application of 1000V and the non-sheet passing portion transferring bias shown in FIG. 2 may be put into the form of a conversion table or a conversion expression in advance, for example, by an experiment or the like.

The timing at which this non-sheet passing portion transferring bias is applied will now be described with reference to FIGS. 3 and 4 already described above.

FIGS. 3 and 4 show in time-series voltages applied to the transferring roller 209 when one-sheet printing (image formation) is effected and when continuous printing is effected, respectively.

As shown in FIG. 3, it is preferable that the time T1 for which the non-sheet passing portion transferring bias is applied be a time corresponding to at least one rotation of the photosensitive drum 201 from the leading edge of the recording material P. However, when as shown in FIG. 4, the non-sheet passing portion T2 between images is less than the amount corresponding to one rotation of the photosensitive drum due to continuous sheet passing or the like, a proper bias in the sheet passing portion is preferentially applied and therefore, there will be no problem even if the application of the above-described non-sheet passing portion transferring bias is less than the amount corresponding to one rotation of the photosensitive drum.

By doing as described above, even if the resistance of the transferring roller 209 is changed by any environmental fluctuation, the amount of plus electrification received by the photosensitive drum 201 in the non-sheet passing portion can be made proper.

This will now be described with reference to FIG. 5. FIG. 5 is a graph showing the amount of plus electrification received by the photosensitive drum 201 in the non-sheet passing portion to the detection current. Heretofore, when the resistance of the transferring roller has lowered and the detection current has become great, the amount of plus electrification received by the photosensitive drum has become excessive and a high density (in the case of reversal developing) image has occurred on the leading edge of the recording material P.

When conversely, the resistance of the transferring roller has risen and the detection current has become small, the amount of plus electrification received by the photosensitive drum has been defined, and when DC electrification is adopted, uneven electrification has occurred in a halftone image or the like.

However, by using the construction and control of the present embodiment, as shown in FIG. 5 described above, the control voltage does not pose the problem as noted above because the amount of plus electrification is controlled to a proper range, and good images have been obtained.

Further, such control as increasing the current value flowing between the transferring roller 209 and the photosensitive drum 201 only in the L/L environment becomes possible, and in the L/L environment wherein uneven electrification is liable to occur, the amount of plus electrification can be positively increased to thereby prevent the occurrence of uneven electrification.

Figure 7:
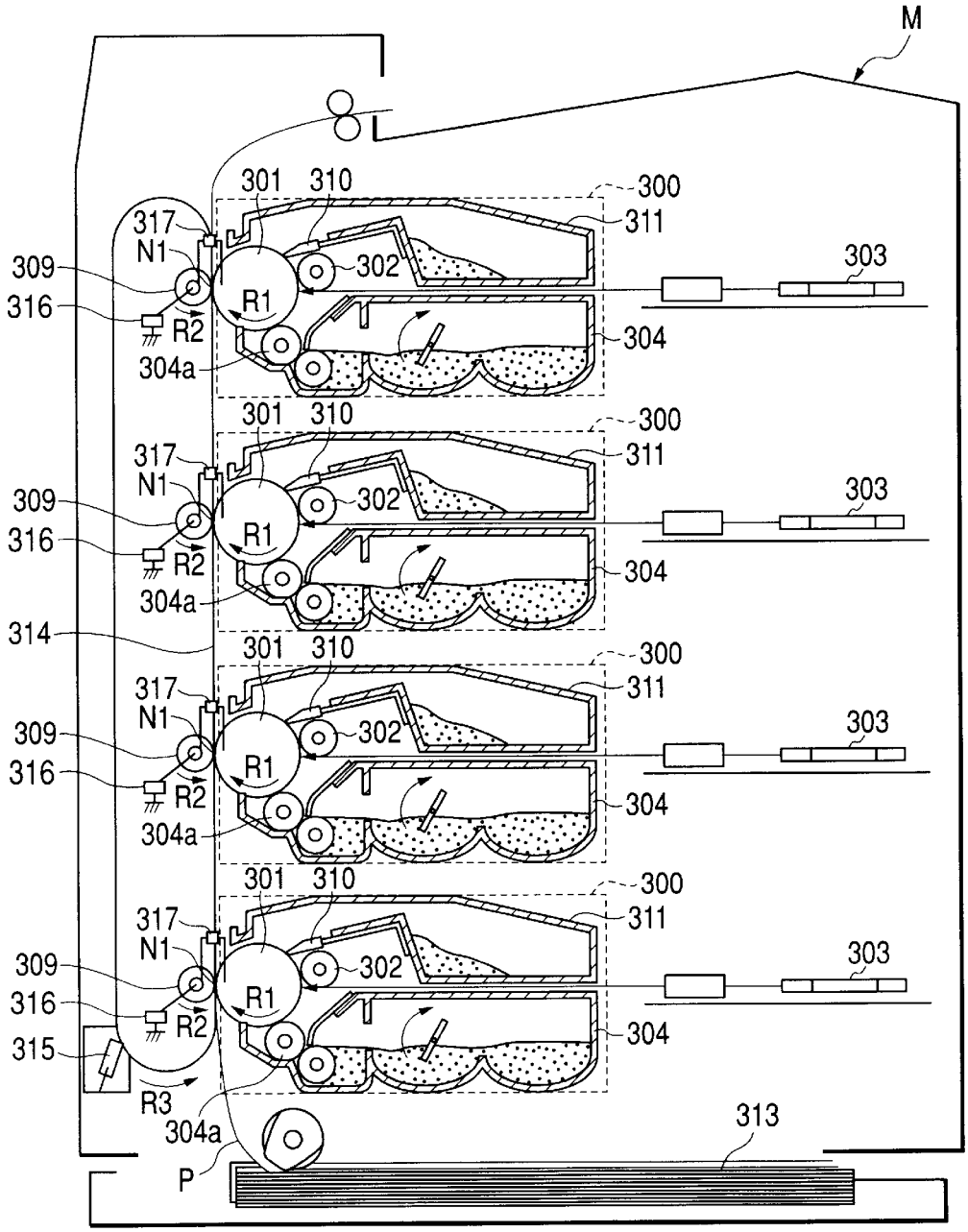
FIG. 7 is a cross-sectional view of an image forming apparatus which is another embodiment of the present invention.
Figure 8:
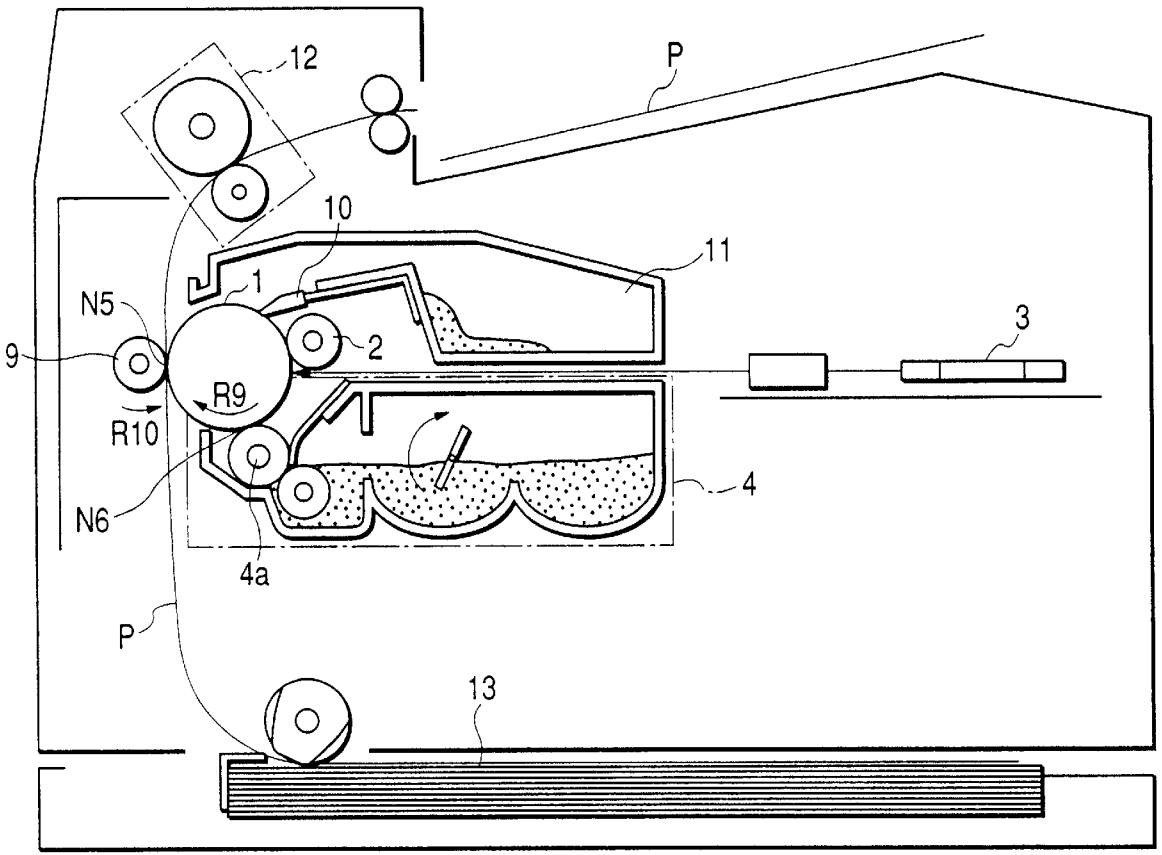
PRIOR ART FIG. 8
FIG. 8 is a cross-sectional view of an image forming apparatus according to the prior art.

FIG. 7 shows an embodiment of the image forming apparatus according to the present invention. The image forming apparatus shown in FIG. 7 is a four color full color laser beam printer of the electrophotographic type, and uses a recording material conveying belt (transferring belt) 314 for conveying a recording material. FIG. 7 is a longitudinal cross-sectional view schematically showing the construction of that apparatus. In the following description, a case where reversal developing is effected by the use of a photosensitive drum 301 of a minus electrification characteristic and toners carrying minus charges will be described as an example.

The image forming apparatus shown in FIG. 7 is provided with four process cartridges, i.e., yellow (Y), magenta (M), cyan (C) and black (K) process cartridges 300Y, 300M, 300C and 300K, detachably attachable to the main body M of the apparatus.

Each of the process cartridges 300Y, 300M, 300C and 300K is provided with a drum-shaped electrophotographic photosensitive member (photosensitive drum) 301 as an image bearing member. The photosensitive drum 301 is rotatably supported by the main body M of the apparatus, and is rotatively driven in the direction of arrow R1 by driving means (not shown). An electrifying roller (electrifying means or a primary electrifier) 302 for uniformly electrifying the surface of the photosensitive drum 301, an exposing apparatus (exposing means) 303 for forming an electrostatic latent image conforming to image information on the surface of the photosensitive drum 301 after electrified, a developing device (developing means) 304 for developing the electrostatic latent image, a transferring roller (transferring means) 309 for transferring a toner image on the photosensitive drum 301 to a recording material P such as paper, and a cleaning apparatus (cleaning means) 310 for removing any untransferred toner on the photosensitive drum 301 are disposed around the photosensitive drum 301 along the direction of rotation thereof substantially in the named order.

Also, around the recording material conveying belt 314, there is disposed a recording material conveying belt cleaning apparatus 315 located so as to be opposed to the recording material conveying belt 314 to remove the toners on the surface of the recording material conveying belt 314 adhering thereto due to jam or the like, and there are further disposed transferring rollers 309 which are transferring members at locations opposed to the photosensitive drums 301 with the recording material conveying belt 314 interposed therebetween. The transferring rollers 309 urge the recording material conveying belt 314 from the back thereof against the surfaces of the photosensitive drums 301.

The above-described members will be complementally described subsequently.

The photosensitive drum 301 is comprised of a cylindrical mandrel (base body) of aluminum and an OPC (organic photosemiconductor) photosensitive layer having, for example, a minus electrification polarity and provided on the surface of the mandrel.

The primary electrifier has the electrifying roller 302 disposed in contact with the surface of the photosensitive drum 301, and an electrification bias application voltage source (not shown) for applying a minus DC (direct current) bias thereto, and electrifies the surface of the photosensitive drum 301 to a predetermined polarity and predetermined potential.

The exposing apparatus 303 has a laser oscillator emitting, for example, a laser beam conforming to the image information, a polygon mirror, etc., and scans the surface of the photosensitive drum after electrified and eliminates the charges of the portion thereof to which the light is applied to thereby form an electrostatic latent image.

The developing device 304 contains therein a negative toner carrying minus charges by friction, and this negative toner is carried on the surface of a developing roller 304*a* and is carried to a developing region facing the surface of the photosensitive drum 301. A developing bias is applied to the developing device 304 by a developing bias application voltage source (not shown), whereby the toner adheres to that portion of the surface of the photosensitive drum 301 from which the charges of the electrostatic latent image have been eliminated. Thus, the electrostatic latent image is developed as a toner image.

The transferring roller 309 urges the recording material conveying belt 314 against the surface of the photosensitive drum 301 to thereby form a transferring region (transferring nip portion) N1 between the recording material conveying belt 314 and the photosensitive drum 301. When the recording material P borne on the surface of the recording material conveying belt 314 passes each transferring region N1, a transferring bias is applied to each transferring roller 309 by a transferring bias application voltage source 316, whereby yellow, magenta, cyan and black toner images may be successively transferred and superimposed on the surface of the recording material P.

The cleaning apparatus 310 is provided with a cleaning blade 310*a* abutting against the surface of the photosensitive drum 301 to thereby scrape off any untransferred toner adhering to the surface of the photosensitive drum into a waste toner container 311.

The operation of the image forming apparatus of the above-described construction will now be described.

A description will first be made of the process of forming an image conforming to yellow image information.

When for example, a DC voltage of −1250V is applied by the yellow electrifying roller 302, the surface of the photosensitive drum 301 is uninformly electrified to −700V, and then exposure conforming to the yellow image information is effected by the exposing apparatus 303, whereby an electrostatic latent image is formed. The surface of the photosensitive drum 301 after exposed is such that the dark portion potential VD of the unexposed portion thereof is −700V and the light portion potential VL of the exposed portion thereof is −100V.

A developing bias of −400V is applied to the developing sleeve 304*a* of the developing device 304, whereby the minus-electrified negative toner does not adhere to the unexposed portion (VD portion) of the surface of the photosensitive drum 301, whereas it adheres to the exposed portion (VL portion) thereof and this portion is visualized (developed) as a yellow toner image.

The photosensitive drum 301 and the transferring roller 309 are rotated substantially at the same peripheral speed in the direction of arrow R1 and the direction of arrow R2, respectively, and a transferring bias is applied to the transferring roller 309 by a transferring bias application voltage source 316. Thereby, the yellow toner image on the photosensitive drum 301 is transferred from the surface of the photosensitive drum 301 to the recording material P electrostatically attracted to the recording material conveying belt 314 being rotated in the direction of arrow R3, in the transferring region N1, by the potential difference between the photosensitive drum 301 and the transferring roller 309.

Any untransferred toner not transferred to the recording material P during the transfer but residual on the surface of the photosensitive drum 301 is removed by the cleaning blade 310*a* of the cleaning apparatus 310 and is collected into a waste toner container 311.

Processes similar to those for the above-described yellow are carried out for each of magenta, cyan and black which are the other three colors. That is, the image forming processes of electrifying, exposing, developing, transferring and cleaning are carried out for each of magenta, cyan and black, whereby toner images of four colors are superimposed on the recording material P on the recording material conveying belt 314.

The recording material P after the transfer of the toner images thereto is separated from the recording material conveying belt 314 and is conveyed to a fixing apparatus 312 by conveying means (not shown), and is heated and pressurized there, whereby the toner images of four colors are fixed on the surface thereof and become a full color image, and the recording material P is discharged out of the main body M of the apparatus.

A description will now be made of the control of the non-sheet passing portion bias which is a feature of the present invention.

First, when the image forming operation is to be started, the yellow photosensitive drum 301 and the yellow transferring roller 309 are rotated in the direction of arrow R1 and the direction of arrow R2, respectively, by driving means (not shown). Likewise, the photosensitive drums 301 and transferring rollers 309 for the other three colors are also rotated.

At this time, a DC voltage of 1000V is applied from the transferring bias application voltage source 316 to the transferring roller 309. An electric current I flowing between the transferring roller 309 and the photosensitive drum 301 when this voltage is applied is detected by detecting means 317. That is, an electric current per the application of 1000V flowing between the photosensitive drum 301 and the transferring roller 309 is detected from I. The detecting means 317 is provided correspondingly to each color, and the detection current is detected for each color.

FIG. 2 is a graph showing the non-sheet passing portion transferring bias to the detection current, and represents such a non-sheet passing portion transferring bias as will cause an optimum current to flow from the detection current to the non-sheet passing portion.

Control is effected so that the control value V of the non-sheet passing portion transferring bias corresponding to the actually detected current I may be determined from the detection current I and FIG. 2, and may be applied to the non-sheet passing portion. The relation between the detection current per the application of 1000V and the non-sheet passing portion transferring bias shown in FIG. 2 may be put into the form of a conversion table or a conversion expression in advance, for example, by an experiment.

The timing at which this non-sheet passing portion transferring bias is applied will now be described with reference to FIGS. 3 and 4 described above.

FIGS. 3 and 4 show in time-series voltages applied to the transferring roller when one-sheet printing is effected and when continuous printing is effected, respectively.

As shown in FIG. 3, it is preferable that a time T1 for which the non-sheet passing portion transferring bias is applied be a time corresponding to at least one rotation of the photosensitive drum 309 from the leading edge of the recording material P. However, when as shown in FIG. 4, due to continuous sheet passing or the like, the non-sheet passing portion T2 between images is less than an amount corresponding to one rotation of the photosensitive drum, a proper bias in the sheet passing portion is preferentially applied and therefore, there will be no problem even if the application of the above-described non-sheet passing portion transferring bias is less than the amount corresponding to one rotation of the photosensitive drum.

By doing as described above, even if the resistance of the transferring roller 309 is changed by any environmental fluctuation, the amount of plus electrification received by the photosensitive drum 301 in the non-sheet passing portion can be made proper.

This will hereinafter be described with reference to FIG. 5 described above. FIG. 5 is a graph showing the amount of plus electrification received by the photosensitive drum 301 in the non-sheet passing portion to the detection current. Heretofore, when the resistance of the transferring roller and the recording material conveying belt has lowered and the detection current has become great, the amount of plus electrification received by the photosensitive drum has become excessive and a high-density (in the case of reversal developing) image has occurred on the leading edge of the recording material.

When conversely, the resistance of the transferring roller and the recording material conveying belt has risen and the detection current has become small, the amount of plus electrification received by the photosensitive drum has been deficient, and when DC electrification is adopted, uneven electrification has occurred to halftone images or the like.

However, by using the construction and control of the present embodiment, as shown in FIG. 5, the control voltage is such that the amount of plus electrification for each photosensitive drum 301 is controlled to a proper range and therefore, the problem as noted above has not arisen in the toner image of any color, but good images have been obtained.

Further, it also becomes possible for such control as increasing the current value flowing between the transferring roller 309 and the photosensitive drum 301 only in the L/L environment to be effected more properly by detecting any change in the resistance of both of the transferring roller 309 and the recording material conveying belt 314, and in the L/L environment under which uneven electrification is liable to occur, the amount of plus electrification can be positively increased to thereby prevent the occurrence of uneven electrification.

In the present embodiment, the same setting is used for the electrification potential for the respective colors, but when the electrification potential for the respective colors is to be changed from necessity, it is also possible to effect control conforming to the electrification potential for the respective colors.

As described above, according to the above-described embodiments, any environmental fluctuation of the transferring member can be detected, a more proper non-sheet passing portion transferring bias can be selected, and the charges received by the image bearing member after having passed the transferring region can be made proper to thereby prevent the occurrence of a high-density image on the leading edge of the recording material due to the increase in the dark attenuation of the image bearing member. Also, when DC electrification is adopted, the occurrence of uneven electrification appearing in a halftone image or the like in a low-temperature and low-humidity environment can be prevented.

Another embodiment of the present invention will now be described.

Figure 9:
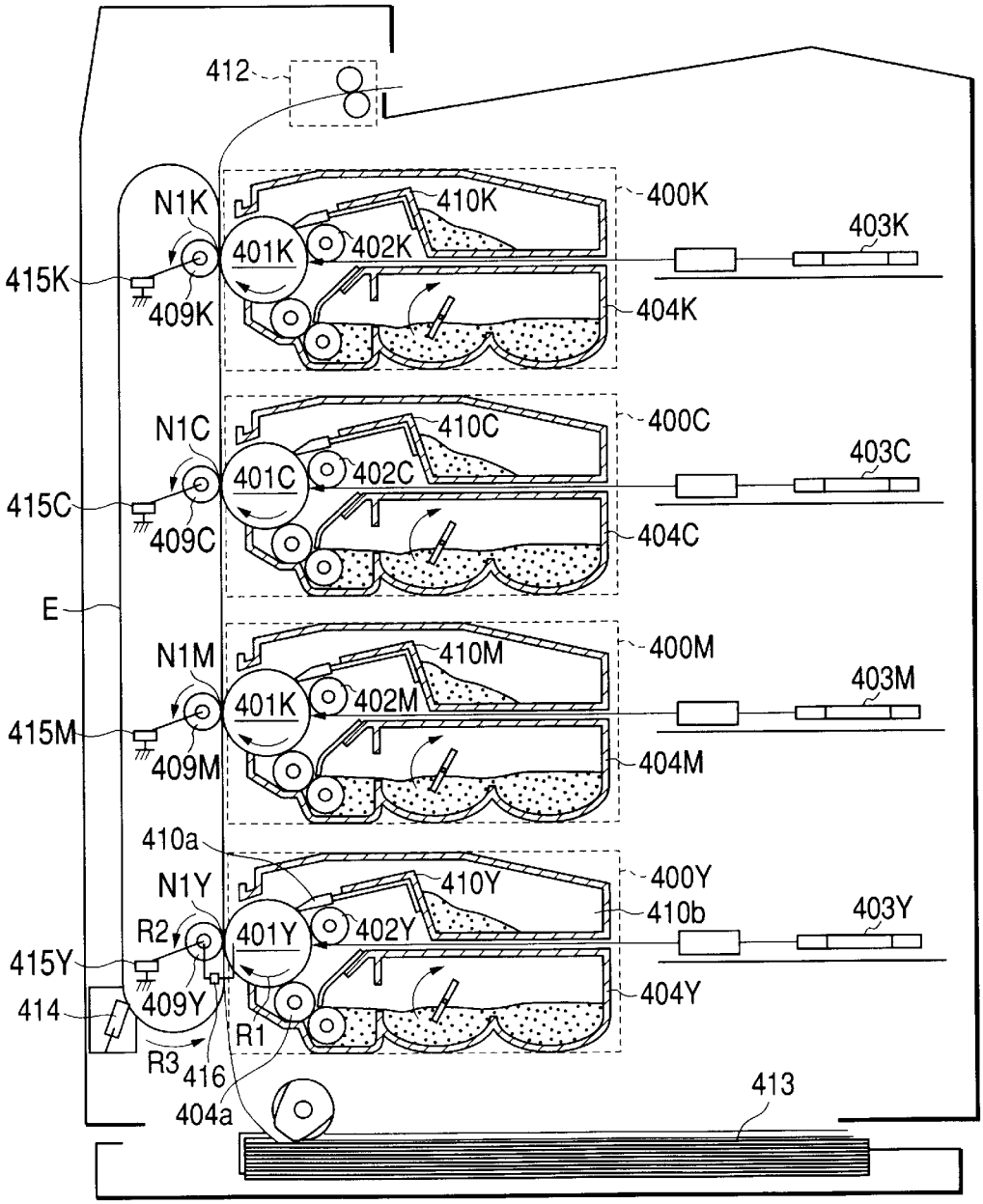
FIG. 9 is a cross-sectional view of an image forming apparatus which is another embodiment of the present invention.

FIG. 9 is a cross-sectional view schematically showing the construction of an embodiment of the image forming apparatus according to the present invention.

This image forming apparatus is a laser beam printer of the electrophotographic type, and uses a conveying belt E as a recording material bearing member. In the following description, a case where a photosensitive drum of a minus electrification characteristic is used as an image bearing member and toners carrying minus charges are used and images are developed by reversal developing to thereby effect image formation will be described.

The image forming apparatus is provided with a plurality of cartridges 400Y, 400M, 400C and 400K detachably attachable to the main body of the apparatus, and the respective cartridges have photosensitive drums (drum-shaped electrophotographic photosensitive members) 401Y, 401M, 401C and 401K as image bearing members. The drum 401 (401Y to 401K) is rotatably supported by the main body of the image forming apparatus, and is rotatively driven in the direction of arrow R1 by driving means (not shown).

A primary electrifier 402 (402Y to 402K), an exposing apparatus 403 (403Y to 403K), a developing device 404 (404Y to 404K), a transferring roller 409 (409Y to 409K) and a cleaning apparatus 410 (410Y to 410K) are disposed around the photosensitive drum 401 along the direction of rotation thereof substantially in the named order. Around the conveying belt E, there is disposed a cleaning apparatus 414 opposed to the conveying belt for removing any toners adhering to the surface of the conveying belt E due to the jam or the like of a recording material.

Briefly describing the above-mentioned members, the photosensitive drum 401 is comprised of a cylindrical mandrel of aluminum and for example, an OPC (organic photosemiconductor) photosensitive layer having a minus electrification polarity and provided on the surface of the mandrel. The primary electrifier 402 is an electrifying roller disposed in contact with the surface of the photosensitive drum 401, and an electrifying bias is applied thereto from a high voltage source, not shown, to thereby uniformly electrify the surface of the photosensitive drum 401. The exposing apparatus 403 has, for example, a laser oscillator emitting a laser beam conforming to image information, a polygon mirror, etc., and scans the surface of the photosensitive drum after electrified and eliminates charges of the portion thereof to which the light is applied, thereby forming an electrostatic latent image conforming to the image information on the surface of the photosensitive drum 401.

The developing device 404 contains therein a negative toner carrying minus charges by friction, and the toner adheres to that portion of the surface of the photosensitive drum 401 from which the charges of the electrostatic latent image have been eliminated (the exposed portion) to thereby develop and visualize the electrostatic latent image as a toner image. The cleaning apparatus 410 has a blade 410*a*, which abuts against the surface of the photosensitive drum 401 to thereby scrape off any untransferred toner adhering to the surface of the photosensitive drum.

The operation of the image forming apparatus of the above-described construction will now be described. The surface of the photosensitive drum 401Y is uniformly electrified to −700V by the electrifying roller 402Y by a vibration voltage comprising an AC voltage of a peak-to-peak voltage 1200V corresponding to 2×Vth superimposed to a DC voltage −700V being applied from a high voltage source to the electrifying roller 402Y. Then, the exposure conforming to yellow image information by the exposing apparatus 403Y is effected, whereby an electrostatic latent image is formed on the surface of the photosensitive drum 401Y. The surface of the photosensitive drum 401Y after exposed is such that the potential (dark portion potential) VD of the unexposed portion thereof is −700V and the potential (light portion potential) VL of the exposed portion thereof is −100V.

A developing bias of −400V is applied to the developing sleeve 404*a* of the developing device 404, whereby the minus-electrified negative toner does not adhere to the unexposed portion (VD portion) of the surface of the photosensitive drum 401Y, whereas it adheres to the exposed portion (VL portion) thereof to thereby develop the latent image (reversal developing) and visualize it as a toner image.

The transferring roller 409Y is rotated in the direction of arrow R2 (forward direction) at the same peripheral speed as that of the photosensitive drum 401Y rotated in the direction of arrow R1, and a transferring bias is applied to the transferring roller 409Y by a high voltage source 415 (415Y to 415K). Thereby, in a transferring nip portion N1Y wherein the photosensitive drum 401Y and the conveying belt E are in contact with each other, the yellow toner image on the photosensitive drum 401Y is transferred to a recording material such as paper borne on and conveyed by the conveying belt E, by the potential difference between the photosensitive drum 401Y and the transferring roller 409Y.

The recording material is conveyed from a sheet feeding apparatus 413 in synchronism with the image formation on the photosensitive drum 401Y, and is supplied to and borne on the conveying belt E. Any untransferred toner not transferred to the recording material in the above-described transfer but residual on the surface of the photosensitive drum 401Y is removed by the blade 410*a* of the cleaning apparatus 410Y and is contained in the waste toner container 410*b* of the apparatus 410Y.

In the manner described above, magenta, cyan and black toner images are formed on the photosensitive drums 401M, 401C and 401K, respectively, by way of the processes of electrifying, exposing and developing, and the toner images are superimposed and transferred onto the recording material on the conveying belt E by the transferring rollers 409M, 409C and 409K in respective transferring nip portions N1M, N1C and N1K, whereby toner images of four colors superimposed one upon another are formed on the recording material. The recording material now with the toner images of four colors transferred thereto is then conveyed from the conveying belt E to a fixing apparatus 412 by conveying means, not shown, and is heated and pressurized by the fixing apparatus 412, whereby the toner images are fixed and formed into a full color permanent image, whereafter the recording material is discharged out of the apparatus.

Now, the present invention is designed such that even if the resistance values of the transferring rollers 409 which are the transferring members, the conveying belt E, etc. are fluctuated depending on the environment, the non-sheet passing portion transferring bias applied to between recording materials is appropriately selected, whereby the electrification received by the photosensitive drums during the passage through the transferring nip portions can be alleviated to thereby prevent a high-density image from being formed on the leading edge of the recording material due to the dark attenuation of the photosensitive drums.

The control of the non-sheet passing portion bias which is a feature of the present invention will hereinafter be described. First, the image forming operation is started and the photosensitive drum 401Y and the transferring roller 409Y are rotated in the direction of arrow R1 and the direction of arrow R2, respectively, and the other photosensitive drums 401M–401K and transferring rollers 409M–409K are likewise rotated.

In the state, a DC voltage of 1000V is applied from a high voltage source, not shown, to the transferring roller 409Y, and an electric current I then flowing between the transferring roller 409Y and the photosensitive drum 401Y is detected by detecting means 416.

When the temperature and humidity of the environment change and the resistance of the members concerned in transfer such as the transferring rollers 409 and the conveying belt E are changed thereby, the current flowing will become different even if the same voltage is applied, and the above-mentioned detection current I corresponds to the resistance of the transferring rollers 409, the conveying belt E, etc. So, when the relation between the detection current I corresponding to the change in the resistance of the members concerned in transfer by the change in the environment and such a non-sheet passing portion bias as will cause an optimum current to flow to the non-sheet passing portion, that is, that the amount of plus electrification received by the photosensitive drum does not become excessive and does not become deficient, is examined, there is obtained a graph as shown in FIG. 10.

Figure 10:
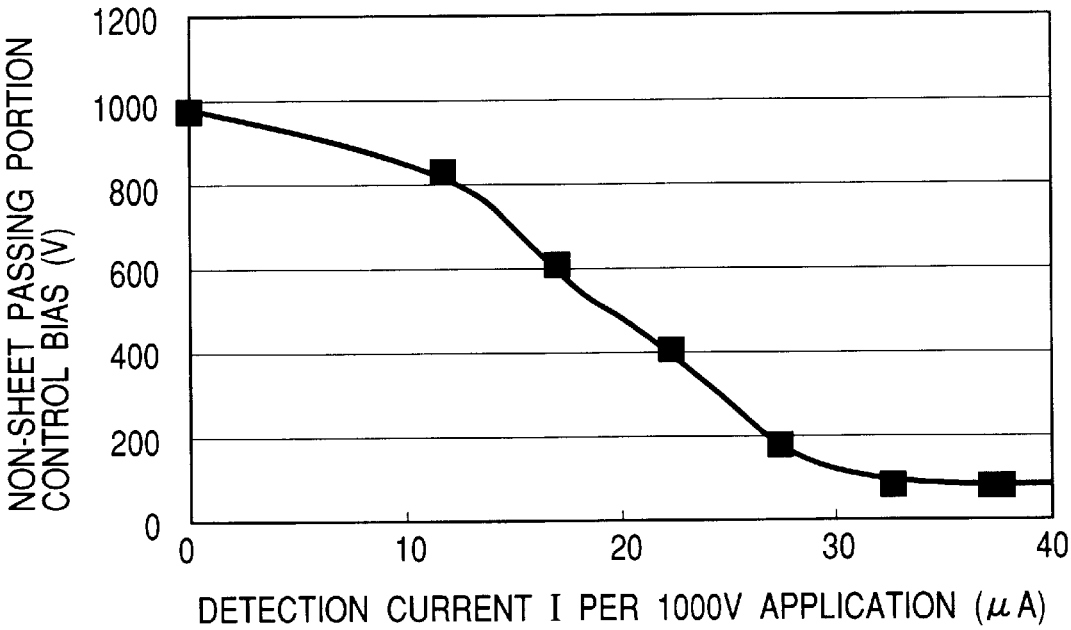
FIG. 10 is a graph showing the relation between the detection current and a non-sheet passing portion transferring bias.

So, in the present embodiment, control is effected so that during image formation, this detection current I may be detected, and the non-sheet passing portion transferring bias (control bias voltage) Vi may be determined from the detected I with reference to the graph of FIG. 10 (given to the image forming apparatus as a conversion expression or a conversion table), and Vi may be applied to each transferring roller 409 when the non-sheet passing portion of the conveying belt E passes each transferring roller 409 (409Y to 409K). That is, in the present embodiment, the control voltage value of the non-sheet passing portion transferring bias determined in the yellow image forming portion is applied not only in the yellow image forming portion, but also in the magenta, cyan and black image forming portions in common.

Figure 11:
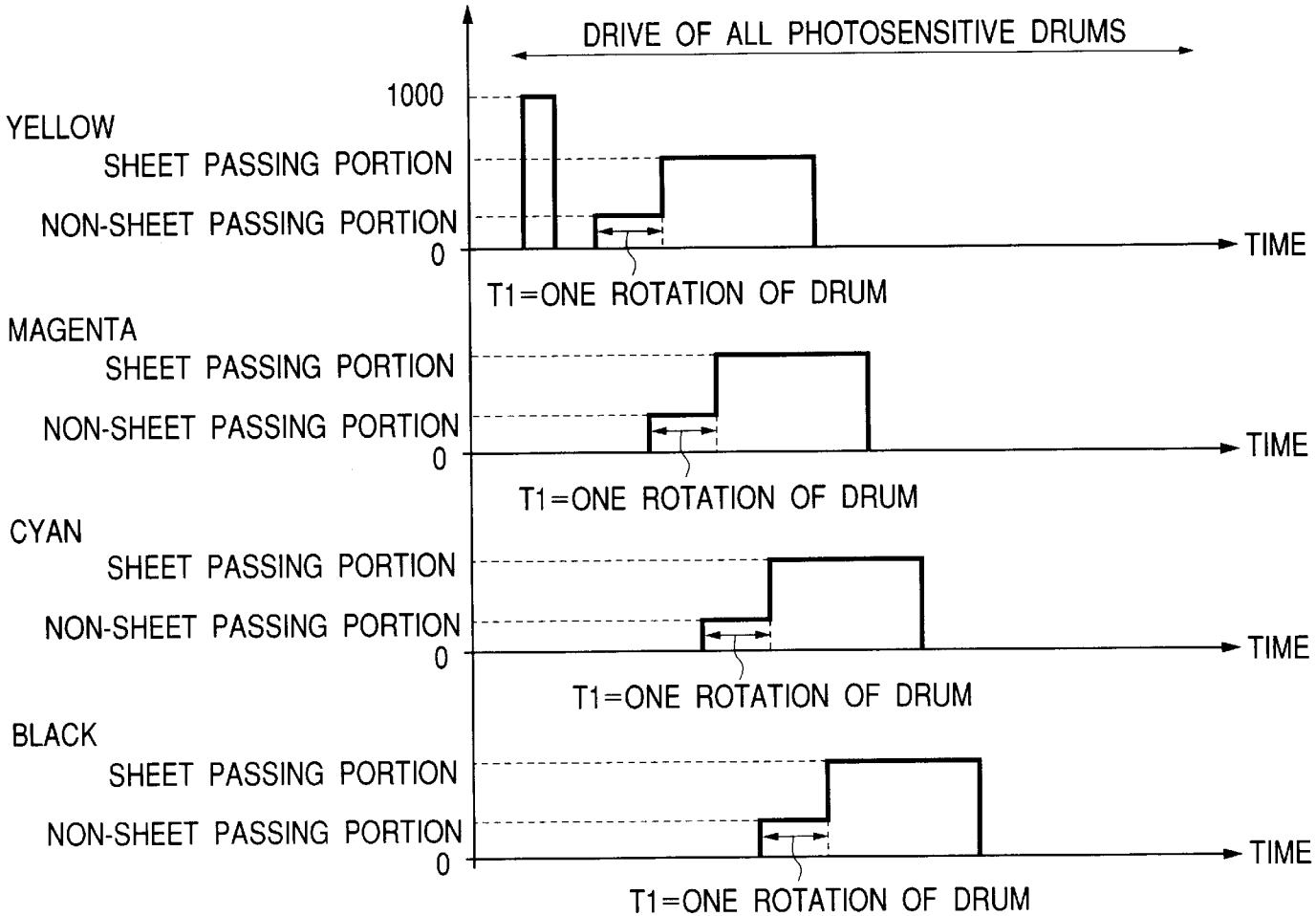
FIG. 11 is a diagram showing the timing at which the non-sheet passing portion transferring bias is applied.

The application timing of the non-sheet passing portion transferring bias during one-sheet printing is shown in FIG. 11. It is preferable that as shown in FIG. 11, a time T1 for which the non-sheet passing portion transferring bias is applied to each transferring roller be a section corresponding to at least one rotation of the photosensitive drum from the leading edge of the recording material or greater. This is because to erase the uneven potential and memory of the whole surface of the photosensitive drum by the application of the non-sheet passing portion bias to thereby suppress the creation of a bad image, it is preferable to effect it to the section corresponding to one rotation of the photosensitive drum or greater.

Figure 12:
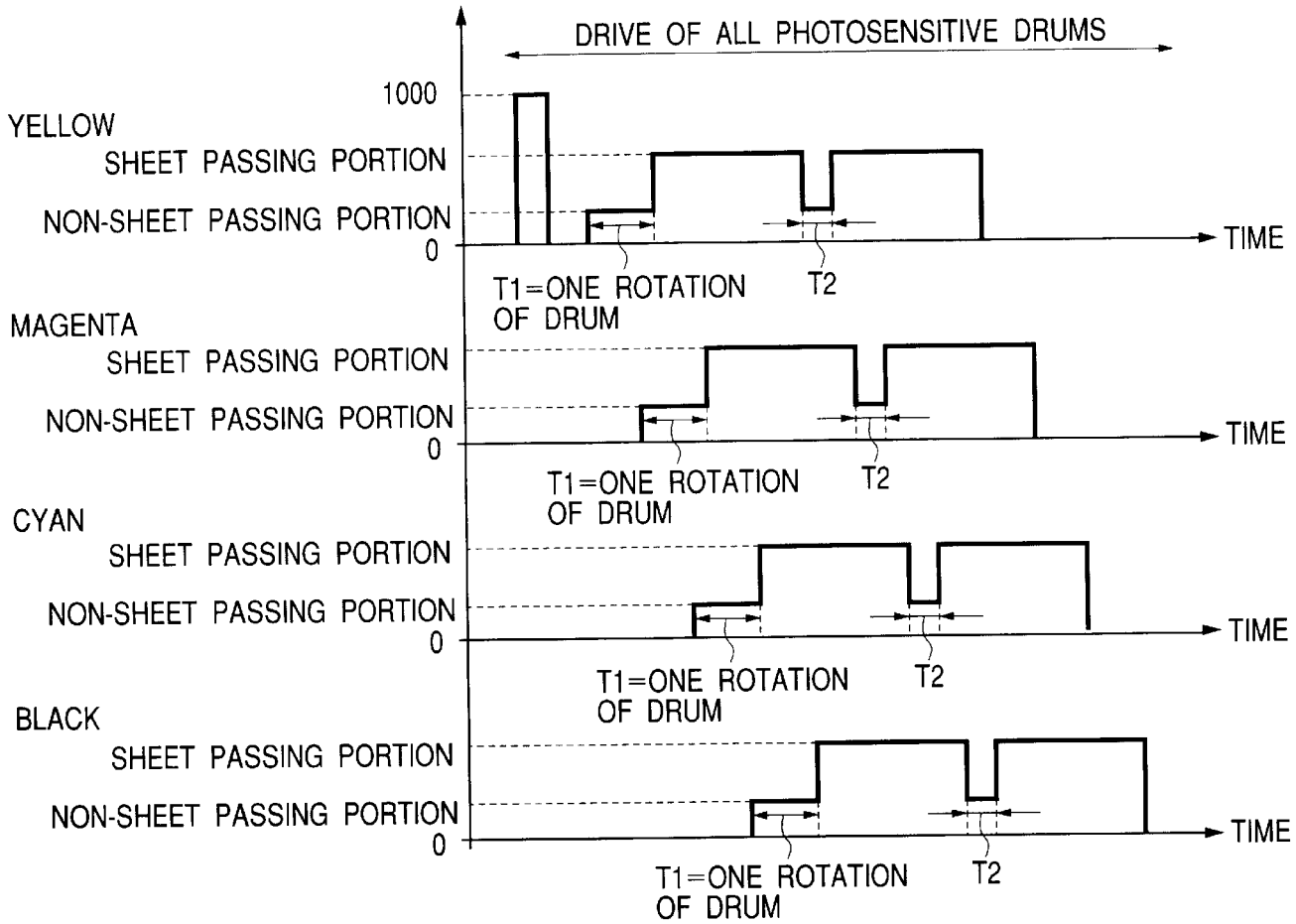
FIG. 12 is a diagram showing the timing at which the non-sheet passing portion transferring bias is applied in continuous printing.

The application timing of the non-sheet passing portion transferring bias during continuous printing is shown in FIG. 12. As shown in FIG. 12, there is a case where in continuous sheet passing or the like, the non-sheet passing portion T2 between recording materials (between images) is less than an amount corresponding to one rotation of the photosensitive drum, but a regular transferring bias in the sheet passing portion is preferentially applied and for the first sheet during continuous printing, the non-sheet passing portion bias is applied for a section corresponding to one rotation or more of the photosensitive drum before the leading edge of the recording material and therefore, there will be no problem even if the application of the non-sheet passing portion bias is less than the amount corresponding to one rotation of the photosensitive drum.

The difference in the change in the amount of plus electrification received by the non-sheet passing portion of the photosensitive drum depending on the presence or absence of the control of the non-sheet passing portion bias by the detection current I will now be described with reference to FIG. 5 described above.

Heretofore, the control of the non-sheet passing portion bias by the detection current I has been absent and therefore, as shown in FIG. 5, as the detection current becomes greater, that is, as the resistance of the transferring roller, etc. lowers, the amount of plus electrification received from the non-sheet passing portion bias by the photosensitive drum rises linearly greatly and the amount of plus electrification easily becomes excessive and as the result, in the case of reversal developing, the badness of image in which the leading edge of the recording material bears a high-density image thereon has occurred (in the case of regular developing, the trailing edge of the recording material bears a low-density image thereon).

In contrast, according to the present embodiment, the control of selecting an appropriate non-sheet passing portion bias by the detection current I has been effected and therefore, as shown in FIG. 5, the increase in the amount of plus electrification received from the non-sheet passing portion bias by the photosensitive drum is gentle relative to the increase in the detection current (the lowering of the resistance of the transferring roller, etc.), and the amount of plus electrification has been controlled to a proper range. As the result, such a problem as the above-noted high-density image on the leading edge of the recording material has not arisen and a good image has been obtained.

As described above, in the present embodiment, when the resistance of the transferring roller 409, etc. becomes small under a high-temperature and high-humidity (H/H, 32.5° C./85%) environment, that fact can be known by the detection current I becoming great and therefore, when the detection current I has become great, a relatively low voltage as the non-sheet passing portion bias (non-image portion potential) Vi is applied to the transferring roller 409, and the fact that conversely under a low-temperature and low-humidity (L/L, 15° C./10%) environment, the resistance of the transferring roller, etc. has become great can be known by the detection current I becoming small and therefore, when the detection current I has become small, the non-sheet passing portion bias Vi is applied relatively high. Under a normal-temperature and normal-humidity (N/N, 25° C./64%) environment, the detection current I exhibits a detection current value substantially intermediate of the above-described high-temperature and high-humidity environment and low-temperature and low-humidity environment and therefore, a voltage substantially intermediate of the high-temperature and high-humidity environment and the low-temperature and low-humidity environment is applied as the non-sheet passing portion bias Vi.

Thus, according to the present embodiment, a substantially optimum non-sheet passing portion transferring bias can be applied under all environments to thereby prevent a bad image such as a high-density image on the leading edge of the recording material or a low-density image on the trailing edge of the recording material, and a good image can be obtained.

Also, in the present embodiment, the control voltage value of the non-sheet passing portion transferring bias determined in the yellow image forming portion is applied not only in the yellow image forming portion but also in the magenta, cyan and black image forming portions in common and therefore, the number of the current detecting means can be one, and this can simplify the construction of the apparatus.

While in the above-described embodiment, a conveying belt is used as a recording material bearing member, use can also be made of a drum-shaped recording material bearing member (so-called transferring drum) to obtain a similar effect.

While in the embodiment shown in FIG. 9, a vibration voltage comprising an AC voltage of a peak-to-peak voltage 1200V (corresponding to 2×Vth) superimposed on a DC voltage −700V has been applied from a high voltage source to each electrifying roller 402 (402Y to 402K) to thereby electrify the surface of each photosensitive drum 401 (401Y to 401K) to −700V, in the present embodiment, a DC voltage −1250V has been applied to each electrifying roller 402 to thereby electrify the surface of each photosensitive drum 401 to −700V. In the other points, the construction of the present embodiment is the same as that of the aforedescribed embodiment and therefore will hereinafter be described with reference to FIG. 9 as required.

As in the aforedescribed embodiment, exposure conforming to the image information of each color is effected on the electrified surface of the photosensitive drum 401 of FIG. 9 by the exposing apparatus 403 (403Y to 403K) to thereby form an electrostatic latent image on the surface of the photosensitive drum 401 at the potential (dark portion potential) VD of the unexposed portion=−700V and the potential (light portion potential) VL of the exposed portion=−100V, and a developing bias of −400V is applied to the developing sleeve 404*a* of the developing device 404 (404Y to 404K) to thereby reversal-develop the latent image, and the thus obtained toner image of each color is superimposed and transferred onto the recording material borne on and conveyed by the conveying belt E in each transferring nip portion N1 (N1Y to N1K) by each transferring roller 409 (409Y to 409K) to which a transferring bias has been applied, and then the recording material is sent to the fixing apparatus 112 to thereby fix the toner images and form them into a full color permanent image.

As described in the aforedescribed embodiment, when the resistance values of the members such as the transferring rollers and he conveying belt concerned in transferring become small by the changes in the temperature and humidity of the environment, the amount of plus electrification received from the non-sheet passing portion transferring bias by the photosensitive drum becomes excessive and a high-density image (in the case of reversal developing) occurs on the leading edge of the recording material. On the other hand, when the resistance values of the members such as the transferring rollers and the conveying belt concerned in transferring become great, the amount of plus electrification received from the non-sheet passing portion transferring bias by the photosensitive drum is deficient, and when DC electrification is adopted for the primary electrification of the photosensitive drum, a desired amount of electrification cannot be locally provided by the primary electrification, and the uneven density (transverse streak) due to uneven electrification occurs to a halftone image or the like.

So, again in the present embodiment, as in the aforedescribed embodiment, the control of the non-sheet passing portion transferring bias is effected. That is, control is effected so that during image formation, a voltage of 1000V may first be applied to the transferring roller 409Y and an electric current I flowing between the transferring roller 409Y and the photosensitive drum 401Y may be detected, and the non-sheet passing portion transferring bias Vi may be determined on the basis of the relation between the detection current I and the optimum sheet passing portion bias as shown in FIG. 10, and Vi may be applied to each transferring roller 409 when the non-sheet passing portion of the conveying belt E passes each transferring roller 409.

Thereby, as shown in FIG. 5, the change in the amount of plus electrification received from the non-sheet passing portion bias by the photosensitive drum becomes gentle relative to the change in the detection current (the change in the resistance of the transferring rollers, etc.), and the amount of plus electrification is controlled to a proper range and therefore, of course, the problem of a high-density image on the leading edge of the recording material has not arisen and the uneven density such as the transverse streak due to the uneven electrification of a halftone image or the like has neither occurred.

While in the foregoing, the control of the non-sheet passing portion bias has been effected under all environments, in the present invention, the resistance of both of the transferring roller and the conveying belt is detected by the detection current which is a detected current flowing between the transferring roller and the photosensitive drum when a predetermined voltage is applied to the transferring roller and therefore, even when such control as increasing the amount of current flowing between the transferring roller and the photosensitive drum by the non-sheet passing portion bias is effected only under a low-temperature and low-humidity (L/L) environment, it becomes possible to control more properly. Accordingly, the prevention of the uneven density due to the uneven electrification of a halftone images or the like under the L/L environment liable to cause uneven electrification can be done more reliably.

In the above-described embodiment, the primary electrification potential of the photosensitive drums for respective colors is the same, but when the electrification potential for each color is to be changed by necessity, it is also possible to control the non-sheet passing portion transferring bias in conformity with the different electrification potential for each color.

As described above, according to the image forming apparatus of the present invention, even if the resistance of the members such as the transferring roller which is a transferring member and the conveying belt concerned in transferring is changed by the environment of use, a predetermined voltage is applied to the transferring member during non-image formation and an electric current then flowing between the transferring member and the image bearing member is detected, and on the basis of the detected current, the non-sheet passing portion bias is determined and controlled and therefore, during image formation, excessive electrification or deficient electrification can be prevented from occurring to the image bearing member electrified by the non-sheet passing portion bias, and the badness of image such as high density on the leading edge of the recording material and the uneven density due to the uneven electrification of a halftone image can be prevented without the use of the ante-electrification exposure and the ante-electrification preliminary electrifying process or the like.

The transferring member is not restricted to a roller, but a blade, a brush, a brush roll or a transferring drum can be used, and even when one of these is used, there can be attained an effect substantially similar to that when the transferring roller is used.

What is claimed is:

1. An image forming apparatus comprising:

an image bearing member; and a transferring member for transferring a toner image on said image bearing member onto a recording material in a transferring portion of the image forming apparatus, wherein, when the recording material is not present in said transferring portion, a predetermined voltage is applied to said transferring member, and on the basis of an electric current then flowing in said transferring member, a voltage applied to said transferring member, when a non-image portion of said image bearing member is present in said transferring portion, is controlled.

2. An image forming apparatus according to claim 1, wherein the non-image portion immediately precedes an image portion of said image bearing member in said transferring portion.

3. An image forming apparatus according to claim 1, wherein said non-image portion is a portion of said image bearing member, which corresponds to a space between a recording material and a recording material.

4. An image forming apparatus according to claim 1, wherein when the recording material is not present in said transferring portion, a predetermined constant DC voltage is applied to said transferring member.

5. An image forming apparatus according to claim 1, wherein the voltage applied to said transferring member is determined from the electric current flowing in said transferring member by the use of one of a predetermined conversion expression and a predetermined conversion table.

6. An image forming apparatus according to claim 1, wherein the voltage applied to said transferring member is a constant-voltage-controlled voltage.

7. An image forming apparatus according to claim 1, wherein said image bearing member is drum-shaped, and the voltage applied to said transferring member, when the non-image portion of said image bearing member is present in said transferring portion, is applied for a duration corresponding to one rotation of said image bearing member.

8. An image forming apparatus according to claim 1, further comprising a process cartridge provided with at least said image bearing member, wherein said process cartridge is detachably attachable to a main body of the image forming apparatus.

9. An image forming apparatus according to claim 1, further comprising a transferring belt bearing the recording material on a surface thereof, and wherein said transferring member presses said transferring belt against said image bearing member from a back side thereof.

10. An image forming apparatus according to claim 1, wherein said transferring member and said transferring portion are each provided in a plurality, and when the recording material is not present in a first transferring portion of the image forming apparatus, a voltage is applied to a first transferring member, and wherein, on the basis of an electric current then flowing in said first transferring member, a voltage applied to a second transferring member, when the non-image portion of said image bearing member is present in a second transferring portion of the image forming apparatus, is controlled.

11. An image forming apparatus according to claim 1, further comprising an electrifying member for electrifying said image bearing member, wherein a voltage comprising a DC voltage and an AC voltage superimposed one upon the other is applied to said electrifying member.

12. An image forming apparatus according to claim 1, further comprising an electrifying member for electrifying said image bearing member, wherein a DC voltage is applied to said electrifying member.

13. An image forming apparatus according to claim 1, wherein a voltage difference exists between the predetermined voltage applied to said transferring member when the recording material is not present in said transferring portion and the voltage applied to said transferring member when the non-image portion of said image bearing member is present in said transferring portion, on the basis of the electric current flowing in said transferring member when the predetermined voltage is applied to said transferring member.

14. An image forming apparatus according to claim 13, wherein a voltage difference exists between the voltage applied to said transferring member when the non-image portion of said image bearing member is present in said transferring portion, on the basis of the electric current flowing in said transferring member when the predetermined voltage is applied to said transferring member and the voltage applied to said transferring member when the image portion of said image bearing member is present in said transferring portion, on the basis of the electric current flowing in said transferring member when the predetermined voltage is applied to said transferring member.

15. An image forming apparatus according to claim 1, wherein a voltage difference exists between the voltage applied to said transferring member when the non-image portion of said image bearing member is present in said transferring portion, on the basis of the electric current flowing in said transferring member when the predetermined voltage is applied to said transferring member and the voltage applied to said transferring member when the image portion of said image bearing member is present in said transferring portion, on the basis of the electric current flowing in said transferring member when the predetermined voltage is applied to said transferring member.

* * * * *

UNITED STATES PATENT AND TRADEMARK OFFICE

CERTIFICATE OF CORRECTION

PATENT NO. : 6,735,402 B2
DATED : May 11, 2004
INVENTOR(S) : Miyuki Oki

It is certified that error appears in the above-identified patent and that said Letters Patent is hereby corrected as shown below:

Column 1,
Line 43, “image)” should read -- image --.

Column 2,
Line 3, “recoding” should read -- recording --.

Column 4,
Line 48, “electrified,” should read -- being electrified, --.

Column 5,
Line 9, “asciallator” should read -- oscillator --.

Column 9,
Line 23, “he” should read -- the --.

Column 10,
Line 3, “form” should read -- from --.

Column 11,
Line 63, “electrified” should read -- being electrified --.

Column 13,
Line 52, “in” should be deleted.

Column 15,
Line 37, “electrified” should read -- being electrified --.

UNITED STATES PATENT AND TRADEMARK OFFICE

CERTIFICATE OF CORRECTION

PATENT NO. : 6,735,402 B2
DATED : May 11, 2004
INVENTOR(S) : Miyuki Oki

It is certified that error appears in the above-identified patent and that said Letters Patent is hereby corrected as shown below:

Column 19,
Line 38, “he” should read -- the --.

Column 20,
Line 47, “badness of” should read -- a poor --.

Signed and Sealed this

Twenty-eighth Day of September, 2004

JON W. DUDAS
*Director of the United States Patent and Trademark Office*